US007731316B2

(12) United States Patent
Wing

(10) Patent No.: US 7,731,316 B2
(45) Date of Patent: Jun. 8, 2010

(54) UNIVERSAL SHELF MODULE FOR A REFRIGERATOR

(75) Inventor: Forrest F. Wing, Des Moines, IA (US)

(73) Assignee: Maytag Corporation, Benton Harbor, MI (US)

( * ) Notice: Subject to any disclaimer, the term of this patent is extended or adjusted under 35 U.S.C. 154(b) by 918 days.

(21) Appl. No.: 11/449,599

(22) Filed: Jun. 9, 2006

(65) Prior Publication Data

US 2007/0284985 A1 Dec. 13, 2007

(51) Int. Cl.
*A47B 96/02* (2006.01)

(52) U.S. Cl. ..... 312/408; 312/404; 108/108

(58) Field of Classification Search ..... 62/382; 312/351, 401, 408, 410; 108/107, 108; 211/90.01, 211/90.02, 90.03, 90.04, 134, 153
See application file for complete search history.

(56) References Cited

U.S. PATENT DOCUMENTS

| | | | | |
|---|---|---|---|---|
| 2,291,547 A | | 7/1942 | Giffard | |
| 2,421,089 A | | 5/1947 | Smith | |
| 4,934,541 A | | 6/1990 | Bussan et al. | |
| 5,340,209 A | | 8/1994 | Kolbe et al. | |
| 5,362,145 A | | 11/1994 | Bird et al. | |
| 5,403,084 A | * | 4/1995 | Kane et al. | 312/408 |
| 5,405,196 A | * | 4/1995 | Shoup et al. | 312/351 |
| 5,429,433 A | | 7/1995 | Bird et al. | |
| 5,441,338 A | | 8/1995 | Kane et al. | |
| 5,454,638 A | * | 10/1995 | Bird et al. | 312/408 |
| 5,516,204 A | * | 5/1996 | Calvert et al. | 312/408 |
| 5,524,981 A | * | 6/1996 | Herrmann et al. | 312/408 |
| 5,540,493 A | | 7/1996 | Kane et al. | |
| 5,564,809 A | | 10/1996 | Kane et al. | |
| 5,735,589 A | * | 4/1998 | Herrmann et al. | 312/408 |
| 5,813,741 A | * | 9/1998 | Fish et al. | 312/408 |
| 5,947,574 A | * | 9/1999 | Avendano | 312/408 |
| 6,065,821 A | * | 5/2000 | Anderson et al. | 312/408 |
| 6,604,800 B2 | | 8/2003 | Hamilton | |
| 6,729,704 B2 | * | 5/2004 | Ames | 312/408 |
| 6,786,562 B2 | | 9/2004 | Obrock et al. | |

(Continued)

FOREIGN PATENT DOCUMENTS

EP 0 679 848 A1 2/1995

(Continued)

*Primary Examiner*—J. Allen Shriver, II
*Assistant Examiner*—Michael Calabrese
(74) *Attorney, Agent, or Firm*—Kirk W. Goodwin; Diederiks & Whitelaw, PLC

(57) ABSTRACT

A refrigerator includes a universal shelf assembly that can be mounted in either a stationary configuration or a sliding configuration. The shelf assembly includes a shelf unit having a base portion surrounded by a peripheral frame. The peripheral frame includes front, rear and opposing side frame members that include a mounting boss and a locating tab. When mounted in the stationary configuration, the shelf unit is mounted directly to a support unit through the mounting boss and locating tab. Conversely, when mounted in the sliding configuration, the shelf unit is mounted indirectly to a support unit. Arranged between the support unit and the shelf unit are glide members. The glide members include structure that cooperates with the mounting boss and locating tab that both secure the shelf unit and enable the shelf unit to shift relative to the support unit.

20 Claims, 9 Drawing Sheets

U.S. PATENT DOCUMENTS

| | | | | |
|---|---|---|---|---|
| 6,851,776 | B2 | 2/2005 | Bienick | |
| 6,994,033 | B2 | 2/2006 | Kweon | |
| 2002/0190620 | A1* | 12/2002 | Vardon | 312/408 |
| 2003/0020387 | A1* | 1/2003 | Wing et al. | 312/408 |
| 2003/0151340 | A1* | 8/2003 | Mathur et al. | 312/408 |
| 2005/0258725 | A1* | 11/2005 | Jang | 312/408 |
| 2006/0145577 | A1* | 7/2006 | Daley et al. | 312/408 |
| 2006/0162373 | A1* | 7/2006 | McMillin et al. | 62/440 |
| 2007/0046160 | A1* | 3/2007 | Egan | 312/408 |
| 2007/0252498 | A1* | 11/2007 | Wing | 312/408 |

FOREIGN PATENT DOCUMENTS

| | | |
|---|---|---|
| FR | 2 663 112 | 12/1991 |

* cited by examiner

UNIVERSAL SHELF MODULE FOR A REFRIGERATOR

BACKGROUND OF THE INVENTION

1. Field of the Invention

The present invention pertains to the art of refrigerators and, more particularly, to a universal shelf module configured to accept a variety of support units to establish a stationary or slide-out shelf configuration in a refrigerator compartment.

2. Discussion of the Prior Art

Refrigerators are available in a variety of different models which range from basic to high-end units. The models vary in numerous aspects including size, components utilized, available features and, accordingly, price. In order to reduce manufacturing costs, it is often desirable to produce certain parts that are common to all, or at least a few, of the various refrigerator models. For example, it is known in the art to utilize a single refrigerator liner in various models and attach different types of shelves and/or bins therein to distinguish between the various models. It is also known to construct door bins that can be incorporated into different units. However, in order to enable similar parts to be employed in more than one model, there must be some basic structure that is common to all or at least a few of the various models.

Increasing the number of common components can result in substantial cost savings that is realized across different product lines. However, attempting to design certain components to be universal can also require major changes to accessories used in combination therewith such that no actual cost savings may be realized. In addition, designing universal components can raise engineering problems, particularly when those components serve different functions and have varying forces exerted upon them.

Therefore, based on the above, there exists a need for universal components that can be incorporated into a variety of refrigerator models. More specifically, there exists a need for a universal shelf module that can be configured in one of a stationary and a sliding configuration, with the shelf module being designed to be incorporated into a variety of refrigerator models.

SUMMARY OF THE INVENTION

The present invention is directed to a shelf module for a refrigerator. More specifically, the present invention is directed to a universal shelf module designed to be mounted in a number of distinct configurations in various refrigerator models. That is, not only can the shelf module serve as a stationary shelf, a compartment top and a slide-out shelf, but the shelf module can also be readily incorporated into a variety of refrigerator models. In accordance with the invention, the shelf module includes a base portion, typically glass, that is provided with a peripheral frame. The peripheral frame includes a front frame member, a rear frame member and opposing side frame members that join to the front and rear frame members. Each of the opposing side frame members includes at least one mounting boss and at least one locating element. The universal shelf module further includes a means for mounting the universal shelf in one of a stationary configuration and a sliding configuration that includes at least one mounting aperture and at least one locating tab.

When mounted in the stationary configuration, the universal shelf module further includes a first support unit having first and second side frame sections that are joined to a rear frame section. Each of the first and second side frame sections is provided with the at least one mounting aperture and at least one locating tab. The mounting aperture is configured to receive the at least one mounting boss while the locating tab is configured to cooperate with the at least one locating element. With this construction, the base portion is secured to the first support unit through the peripheral frame. This configuration can be employed as a support for a sliding drawer, or simply serve as a stationary shelf mounted in a refrigerator compartment.

Conversely, when mounted in the sliding configuration, a second support unit is employed in place of the first support unit. The second support unit includes first and second side frame sections that are joined to a rear frame section. The second support unit is also provided with first and second glide members that are slidingly supported on corresponding ones of the first and second side frame sections. In a manner similar to that described above, each of the first and second glide members is provided with the at least one mounting aperture and at least one locating tab. The mounting aperture is configured to receive the at least one mounting boss, while the locating tab is configured to cooperate with the at least one locating element. With this construction, the base portion and peripheral frame can slide relative to the second support unit to facilitate access to items stored thereupon.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
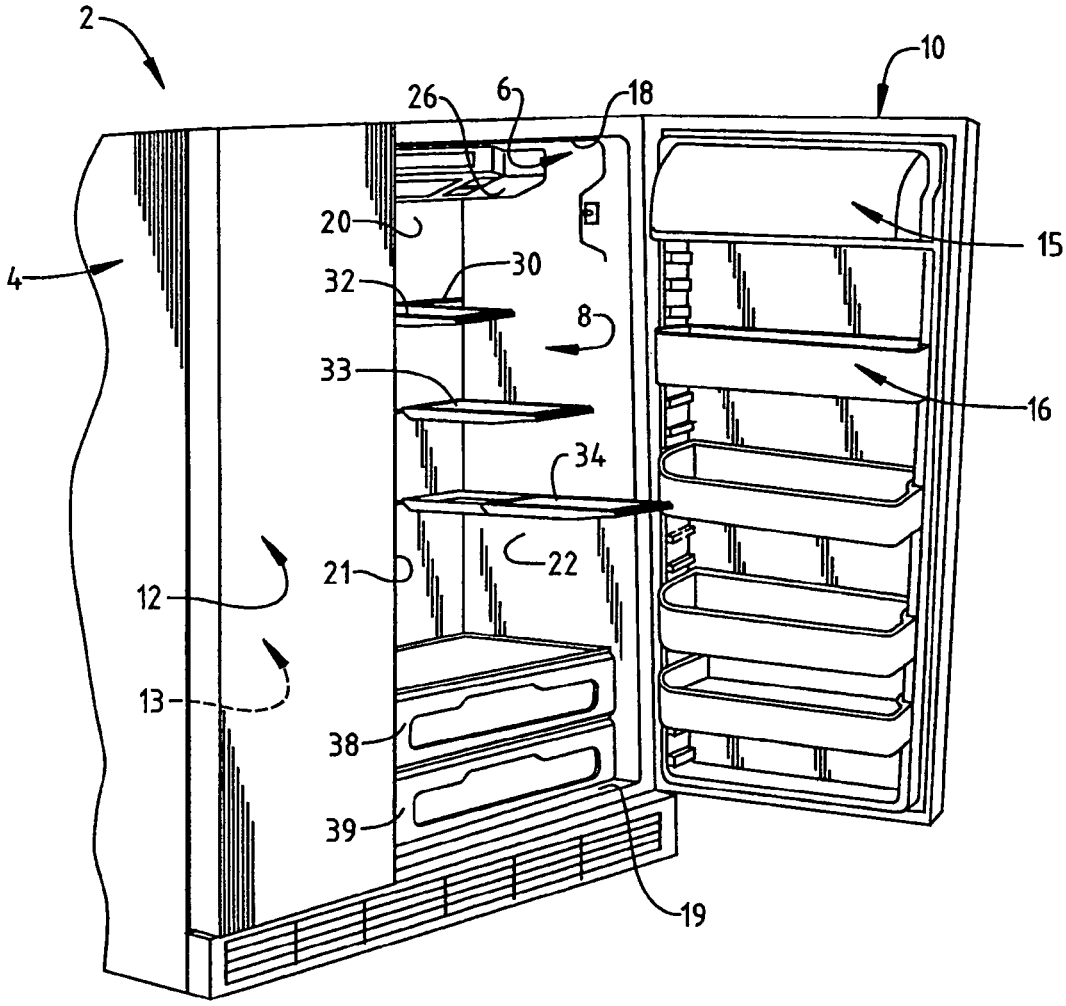
FIG. 1 is a perspective view of a refrigerator incorporating a universal shelf module constructed in accordance with the present invention.

With initial reference to FIG. 1, a refrigerator 2 includes an outer shell or cabinet 4 within which is positioned a liner 6. In a manner known in the art, liner 6 defines a fresh food compartment 8. In a manner also known in the art, fresh food compartment 8 can be accessed by the selective opening of a fresh food door 10. In a similar manner, refrigerator 2 includes a freezer door 12 that can be selectively opened to access a freezer compartment 13. For the sake of completeness, door 10 of refrigerator 2 is shown to include a dairy compartment 15, as well as various vertically adjustable shelving or pick-off bucket units, one of which is indicated at 16.

As shown, fresh food compartment 8 includes top, bottom, rear and opposing side walls 18-22. Mounted in an upper region of fresh food compartment 8 is a temperature control housing or user interface 26. Extending laterally across rear wall 20 of fresh food compartment 8 are a plurality of shelf support rails, one of which is indicated at 30. As will be discussed more fully below, shelf support rails 30 constitute mounting structure for a plurality of vertically spaced, universal shelf modules 32-34 constructed in accordance with the present invention. Finally, at a lowermost portion of fresh food compartment 8 is illustrated a pair of temperature or climate controlled storage bins 38 and 39.

Figure 2:
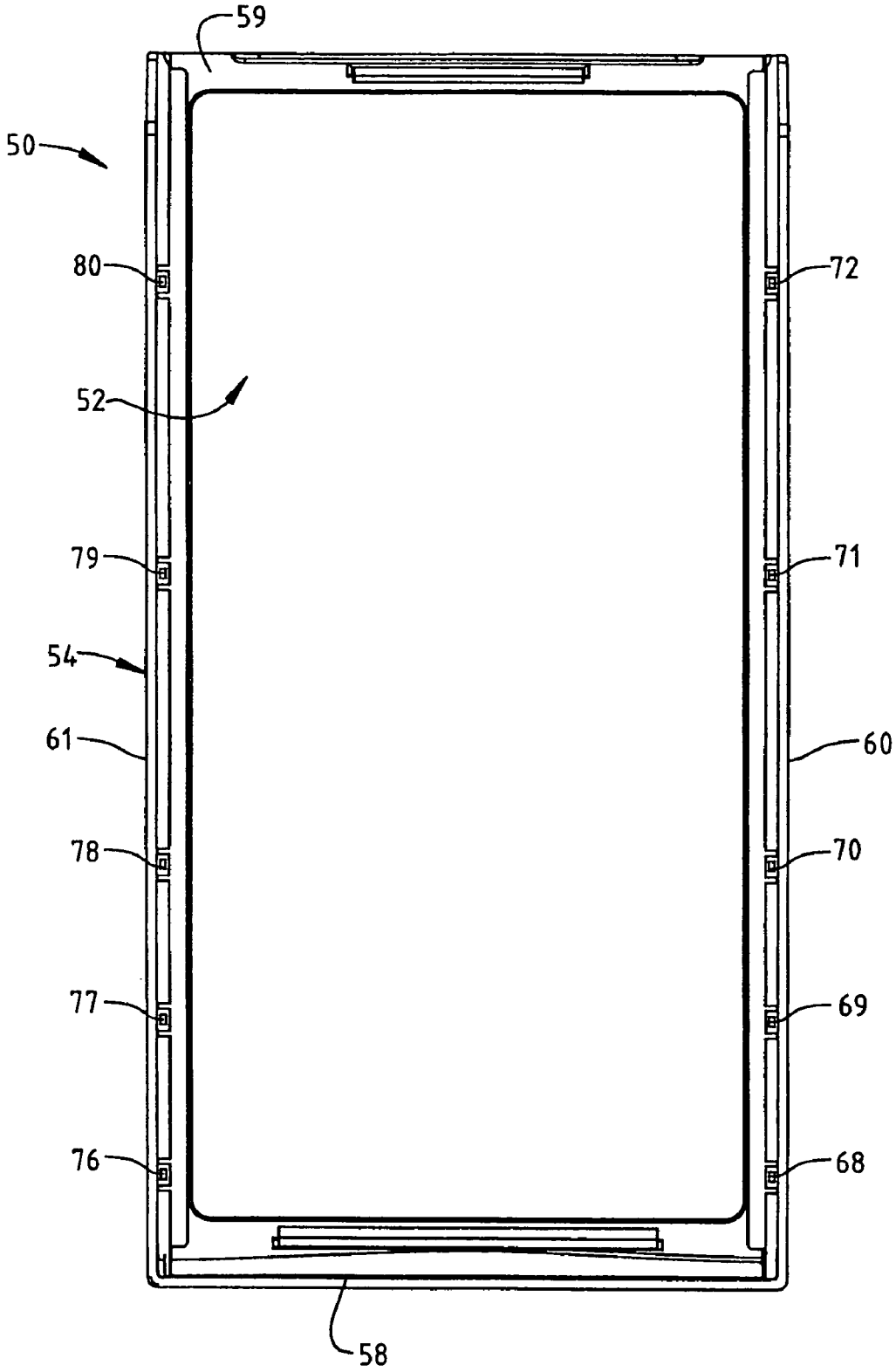
FIG. 2 is a lower, plan view of a shelf unit portion of the universal shelf module of the present invention.

As indicated above, the present invention is directed to the details of universal shelf modules 32-34. In accordance with the invention, each universal shelf module 32-34 is configured to be mounted in either a stationary configuration, with reference to shelf modules 32 and 33, or a sliding configuration, such as illustrated by shelf module 34. Towards that end, as shown in FIG. 2, each shelf module 32-34 includes a shelf unit 50 having a base or platform portion 52 surrounded by a peripheral frame 54. Base portion 52 is formed from, for example, tempered glass and is sealed to peripheral frame 54 in such a way so as to prevent any liquids which may be spilled upon shelf unit 50 from entering into a space (not separately labeled) between peripheral frame 54 and base portion 52. In any case, peripheral frame 54 is formed by joining a front frame member 58, a rear frame member 59 and opposing side frame members 60 and 61. Actually, peripheral frame 54 could be formed from various individual pieces and thereafter joined together or, alternatively, formed by injection molding as a single unit.

Figure 3:
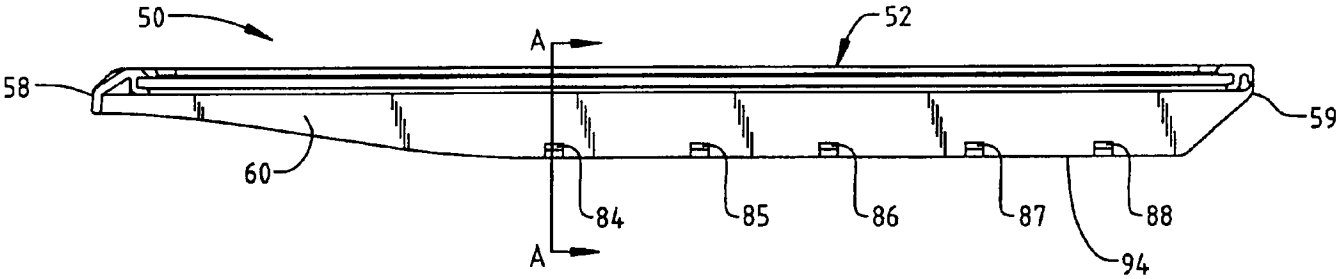
FIG. 3 is a partially cut-away left side view of the shelf unit of FIG. 2.
Figure 4:
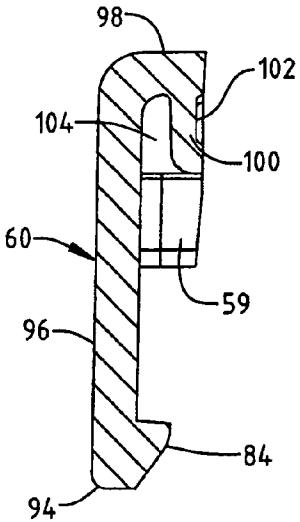
FIG. 4 is a partially cut-away view of a side portion of the shelf unit of taken along the line 4-4.

With reference to FIGS. 2-4, arranged along each side frame member 60 and 61 are a plurality of locating elements 68-72 and 76-80 respectively. Each side frame member 60, 61 is also formed with a plurality of mounting bosses, such as indicated at 84-88 for side frame member 60 in FIG. 3. Mounting bosses 84-88 actually project from directly adjacent a bottom edge portion 94 of each side frame member 60 and 61. As best shown in FIG. 4, bottom edge portion 94 extends to a side portion 96 which leads to a top surface 98. Extending downward from top surface 98 is a channel defining member 100 that is sized to receive base portion 52. Channel defining member 100 is also spaced from side portion 96 so as to form a groove 104. As will be discussed more fully below, this overall construction allows shelf unit 50 to be selectively mounted in one of a stationary configuration and a sliding configuration.

Reference will now be made to FIGS. 5-8 in describing universal shelf module 32 arranged in a stationary configuration. In accordance with the invention, when employed in a stationary configuration, universal shelf module 32 includes shelf unit 50, as well as a first support unit 116. As shown, first support unit 116 includes a rear frame section 118 having a first end 120 that extends to a second end 121 through an intermediate section 122. In accordance with one aspect of the invention, rear frame section 118 is provided with a pair of hook members, one of which is shown at 125 in FIG. 6, that are used to mount first support unit 116 to shelf support rail 30 in fresh food compartment 8. In accordance with another aspect of the invention, hook members 125 enable shelf module 32 to shift relative to shelf support rail 30. That is, while universal shelf module 32 can shift laterally in fresh food compartment 8 as desired by a consumer, shelf unit 50 is fixed relative to first support unit 16.

Figure 5:
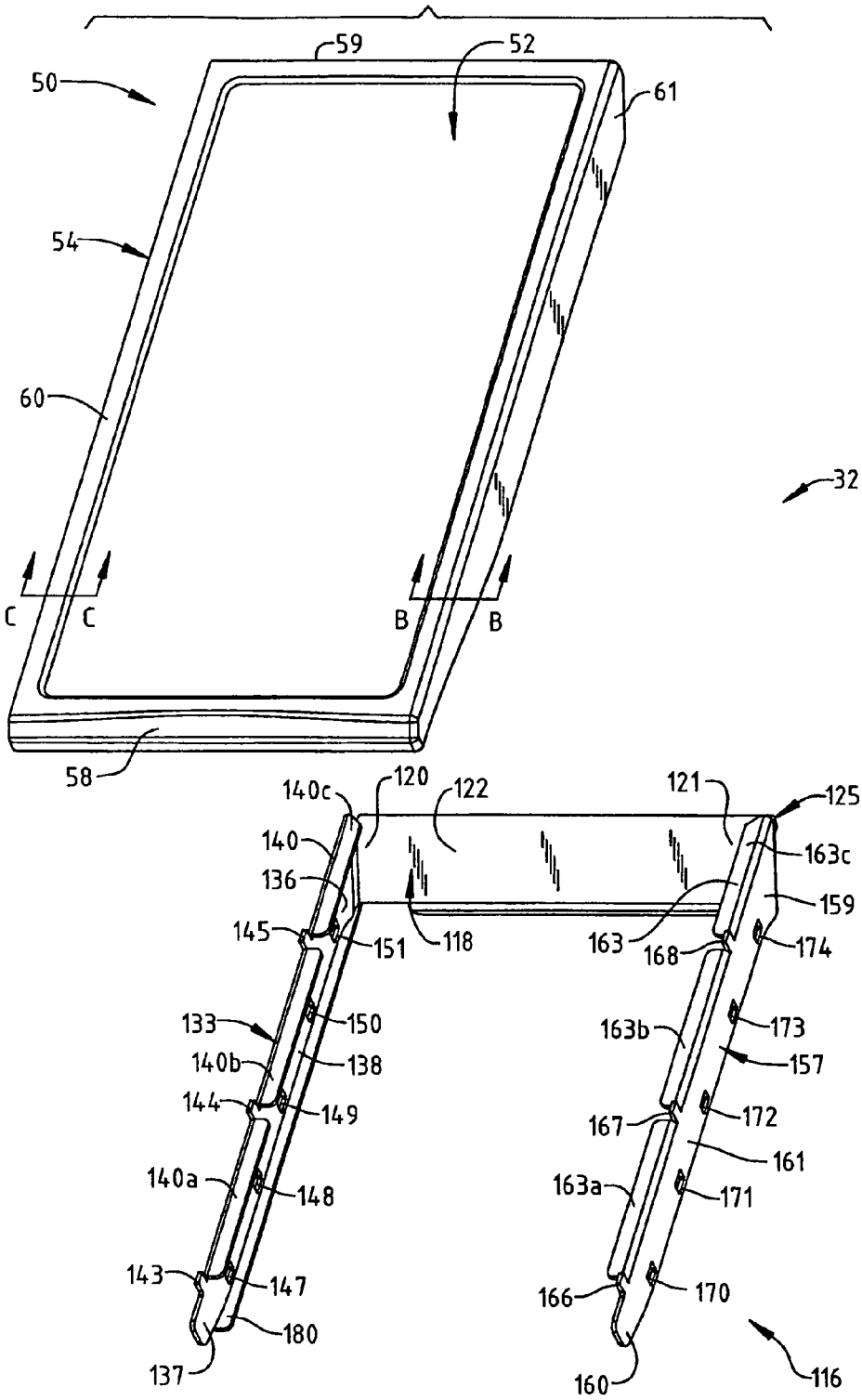
FIG. 5 is an exploded view of the universal shelf module of the present invention illustrating a shelf unit and support unit in a stationary configuration.
Figure 6:
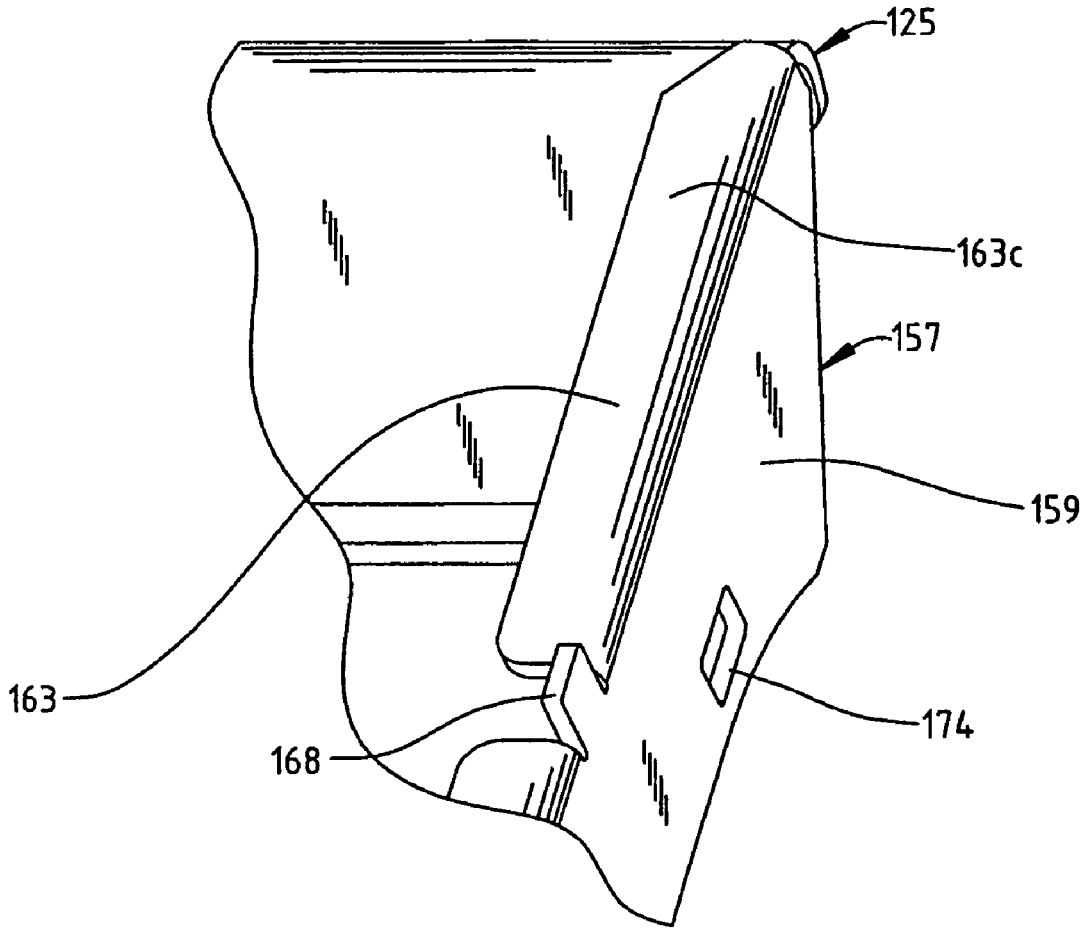
FIG. 6 is a partial, perspective view of a rear corner portion of the support unit of FIG. 5.
Figure 8:
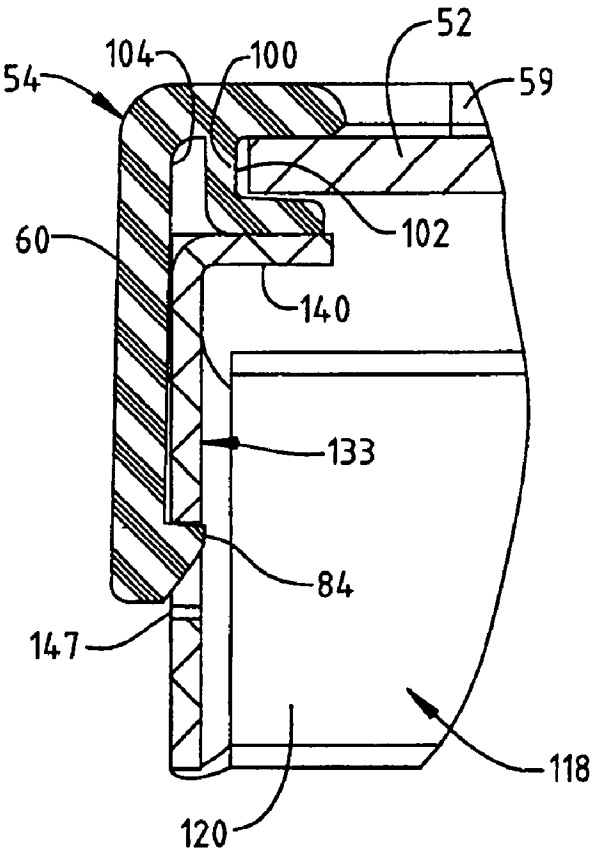
FIG. 8 is a partially cut-away view of the universal shelf module of FIG. 5 taken along lines 8-8.
Figure 7:
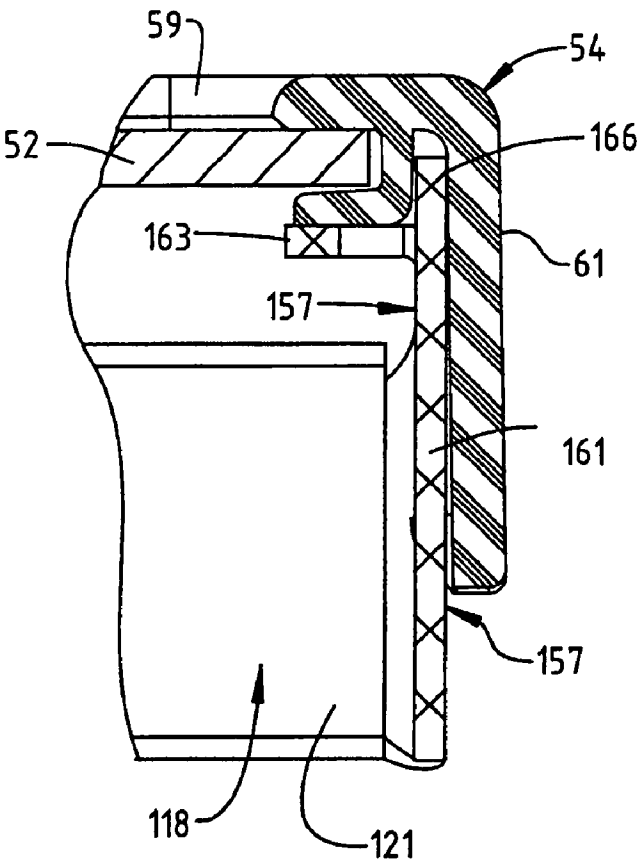
FIG. 7 is a partially cut-away view of the universal shelf module of FIG. 5 taken along lines 7-7.

In further accordance with the invention, extending from first end 120 of rear frame section 118 is a first side frame section 133. As best shown in FIG. 5, first side frame section 133 includes a first end 136 that is joined to rear frame section 118 and extends to a second, cantilevered end 137 through an intermediate section 138. First side frame section 133 also includes a top portion 140 which, as will be discussed more fully below, includes three distinct sections 140A, 140B and 140C. Top portion 140 is actually formed by bending an upper edge (not separately labeled) of intermediate section 138 to a substantially 90° angle. In folding over top portion 140 in three sections, 140A, 140B and 140C, a plurality of locating tabs 143-145 remain as extensions of first side frame section 133. In addition, first side frame section 133 is provided with a plurality of mounting apertures 147-151 which, as will be discussed more fully below, cooperate with locating elements 68-72 to secure shelf unit 50 to first support unit 116.

First support unit 116 further includes a second side frame section 157 which is constructed in a manner corresponding to that described with respect to first side frame section 133. Towards that end, second side frame section 157 includes a first end 159 that extends, substantially perpendicularly, from rear frame section 118 to a second, cantilevered end 160 through an intermediate portion 161. In a manner also similar to that described above, second side frame section 157 includes a top portion 163 divided into three sections 163A, 163B and 163C so as to define a plurality of locating tabs 166-168 that are arranged so as to cooperate with locating elements 76-80. Second side frame section 157 is also provided with a plurality of mounting apertures 170-174 that cooperate with locating elements 76-80 for retaining shelf unit 50. In accordance with one aspect of the present invention, first support unit 116 is actually formed from a single, stamped sheet of metal such that first and second side frame sections 133 and 157 are formed by creating bends at points defined by first and second ends 120 and 121 of rear frame section 118.

With this construction, shelf unit 50 is placed over first support unit 116 such that locating tabs 143-145 and 166-168 align with locating elements 68-72 and 76-80 respectively. Once properly positioned, shelf unit 50 is shifted so that mounting bosses 84-88 engage into mounting apertures 147-151 and a corresponding set of mounting bosses (not shown) engage into mounting apertures 170-174 so as to secure shelf unit 50 to first support unit 116 and complete a stationary configuration for universal shelf module 32. After shelf unit 50 is secured to first support unit 116, universal shelf module 32 is installed into fresh food compartment 8 of refrigerator 2. At this point, it should be noted that universal shelf module 32 can also be employed as a top for a storage bin in the event that first support unit 116 is provided with an optional drawer/bin support such as shown at 180. Universal shelf module 32 may also serve as a stationary shelf and may also be supported for lateral sliding movement along shelf support rail 30.

Figure 9:
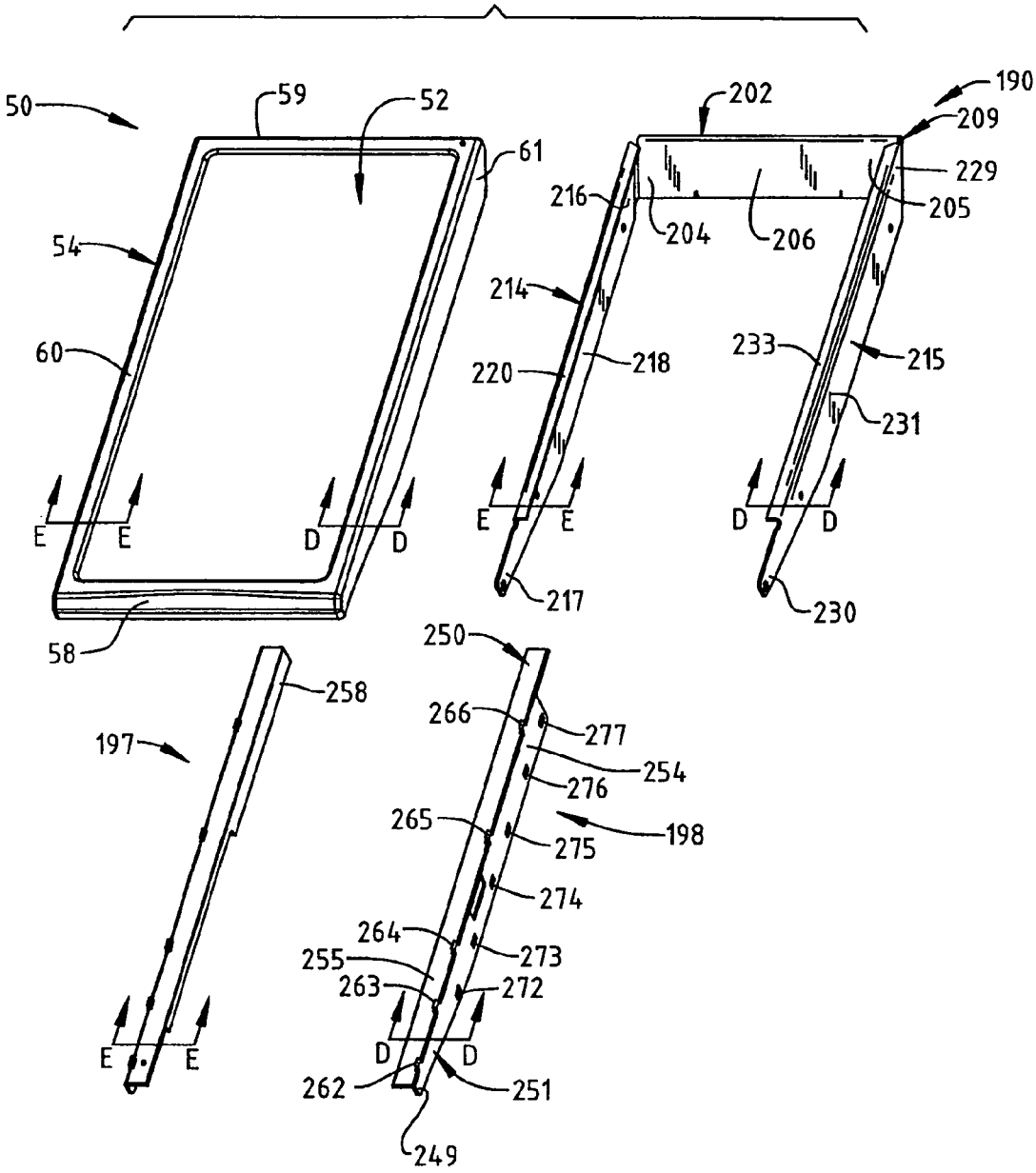
FIG. 9 is an exploded view of the universal shelf module illustrating shelf unit and support unit of a sliding configuration.

In accordance with another aspect of the present invention, universal shelf module 34 can be employed in a sliding or extensible configuration wherein shelf unit 50 is supported for sliding movement. When employed in the sliding configuration, shelf unit 50 is indirectly mounted to a second support unit 190 through first and second glide members 197 and 198 such as illustrated in FIG. 9. Second support unit 190 includes a rear frame section 202 having a first end portion 204 that extends to a second end portion 205 through an intermediate section 206. Rear frame section 202 is provided with a pair of hook members, one of which is shown at 209, that are adapted to hang on shelf support rail 30 in fresh food compartment 8. In a manner similar to that described above with reference to first support unit 116, second support unit 190 is preferably formed from a single, stamped sheet of metal that is folded at points defined by first and second end portions 204 and 205 so as to form first and second side frame sections 214 and 215.

Figure 10:
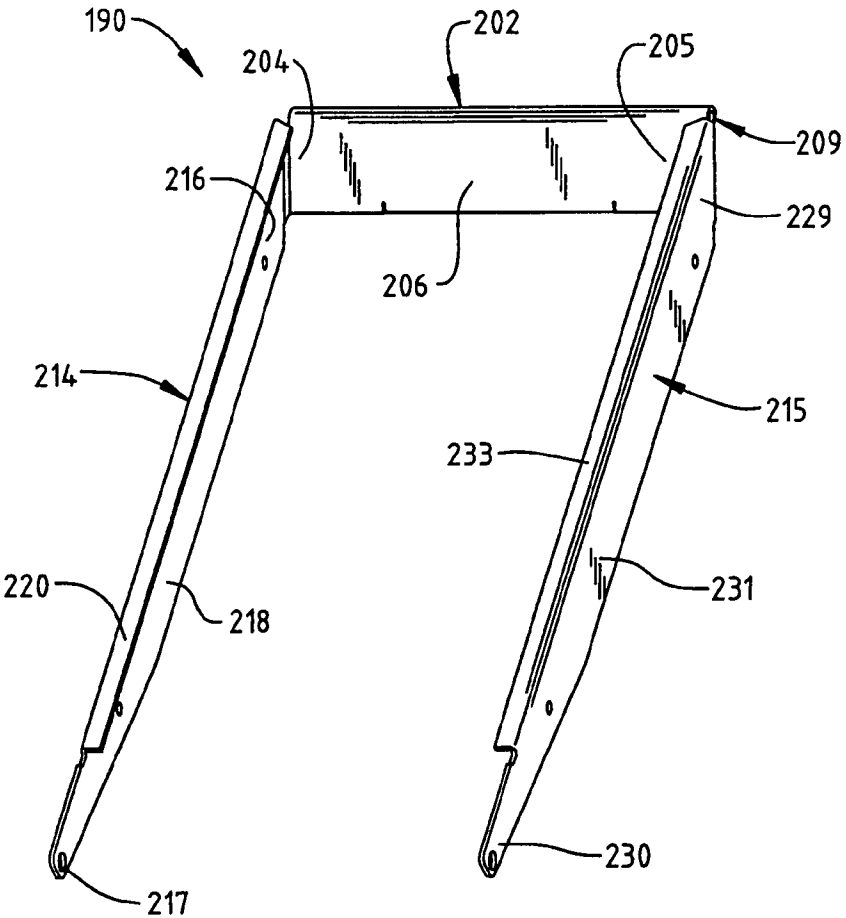
FIG. 10 is an upper right perspective view of a support unit of FIG. 9.
Figure 13:
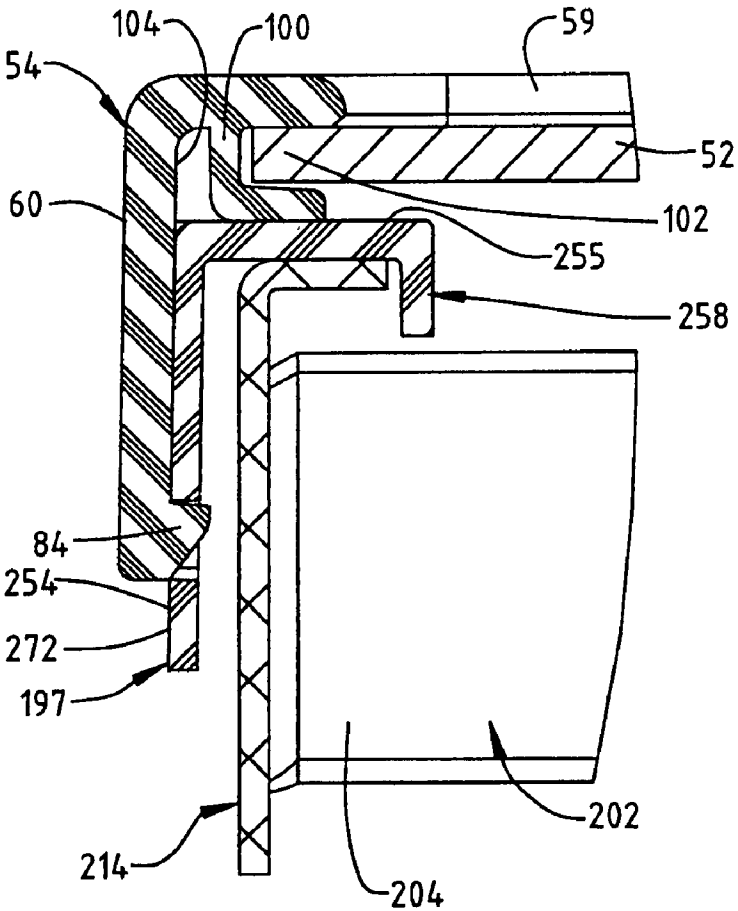
FIG. 13 is a partially cut-away view of the universal shelf module of FIG. 9 taken along lines 13-13.
Figure 12:
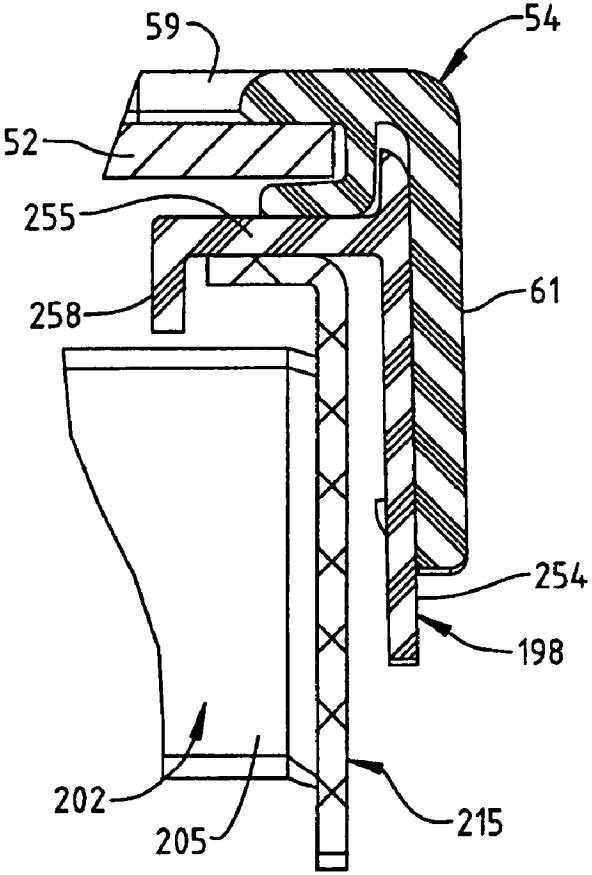
FIG. 12 is a partially cut-away view of the universal shelf module of FIG. 9 taken along lines 12-12.

As best shown in FIG. 10, first side frame section 214 includes a first end 216 that extends substantially perpendicularly from first end portion 204 towards a second, cantilevered end 217 through an intermediate portion 218. In a manner similar to that described above, first side frame section 214 is provided with a top or glide surface 220 which, in contrast to the embodiment described above, is preferably constituted by a continuous, substantially smooth, planar surface that extends nearly the entire length of intermediate portion 218. Likewise, second side frame section 215 includes a first end 229 that extends, substantially perpendicularly from second end 205 of rear frame section 202 towards a second, cantilevered end 230 through an intermediate portion 231. Second side frame section 215 is also provided with a top or is glide surface 233 that extends substantially an entire length of intermediate portion 231. As will be detailed more fully below, top or glide surfaces 220 and 233 provide a support surface for first and second glide members 197 and 198.

Figure 11:
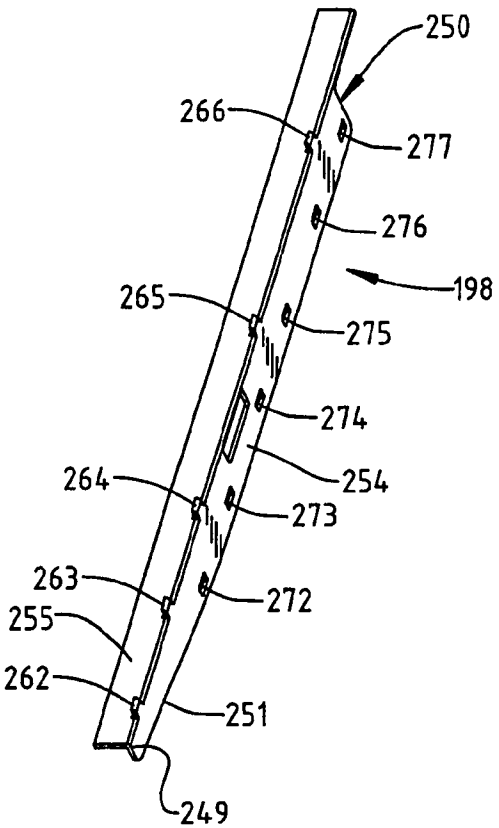
FIG. 11 is an upper right perspective view of a glide member portion of the universal shelf module of FIG. 9.

As first glide member 197 is a mirror image of second glide member 198 so as to include all corresponding structure, a detailed description will be made with respect to second glide member 198 illustrated in FIG. 11 with an understanding that first glide member 197 is similarly constructed. Second glide member 198 includes a first end 249 that extends to a second end 250 through an intermediate or glide portion 251. More specifically, second glide member 198 is substantially L-shaped in cross-section so as to include an outside wall 254 that is joined to or integrally formed with a top wall 255. Second glide member 198 is also shown to include an inside wall, such as illustrated at 258 in FIG. 9 for first glide member 197, that extends from second end 250 and partially along intermediate portion 251. In accordance with the invention, second glide member 198 is further provided with a plurality of locating tabs 262-266 which project, substantially perpendicularly, from top wall 255. In addition, outside wall 254 is provided with a plurality of mounting apertures 272-275 which, as will be discussed more fully below, cooperate with locating elements 76-80 to secure shelf unit 50 to second support unit 190.

In accordance with this aspect of the invention, universal shelf module 34 is formed by securing first and second glide members 197 and 198 to shelf unit 50. More specifically, first and second glide members 197 and 198 are positioned along an underside of shelf unit 50 such that locating tabs 262-266 of each glide member 197 and 198 align with corresponding ones of locating elements 68-72 and 76-80. Once properly aligned, glide members 197 and 198 are shifted so as to enable mounting bosses 84-88 to engage with mounting apertures 272-275, thereby securing glide members 197 and 198 to shelf unit 50 in a manner similar to that described above with respect to first support unit 116. At this point, shelf unit 50 is positioned such that glide members 197 and 198 align with and rest upon glide surfaces 220 and 233. Thereafter, shelf unit 50 is shifted rearward, enabling stop units (not shown) to properly engage.

With this construction, shelf unit 50 can be shifted relative to second support unit 190 so as to facilitate access to food items stored thereon. That is, shelf unit 50 can extend outward from fresh food compartment 8 to provide access to food items stored at a rear portion thereof. In any case, it should be understood that the present invention allows a single shelf unit to be mounted in a variety of configurations in a refrigerator depending upon the structural considerations, model type and consumer preferences. The use of a single shelf unit in a variety of applications reduces manufacturing costs which, in the highly competitive field of home appliances, is desirable. Although described with reference to preferred embodiments of the invention, it should be readily understood that various changes and/or modifications can be made to the invention without departing from the spirit thereof. In general, the invention is only intended to be limited by the scope of the following claims.

I claim:

1. A refrigerator comprising:

a cabinet shell;

a liner arranged within the cabinet shell, said liner defining at least a fresh food compartment having top, bottom, rear and opposing side walls;

a door pivotally mounted relative to the cabinet shell for selectively closing the fresh food compartment;

at least one shelf support rail mounted to one of the rear and opposing side walls of the fresh food compartment; and a universal shelf module configured to be mounted in one of a stationary configuration and a sliding configuration, said universal shelf module including a shelf unit having a base portion and a peripheral frame, said peripheral frame including a front frame member, a rear frame member and opposing side frame members joined to the front and rear frame members, each of said opposing side frame members including a bottom edge portion, a top surface portion, a side portion extending from the bottom edge portion to the top surface portion, a channel defining member which is sized to receive the base portion and being spaced from the side portion to define a groove, at least one mounting boss projecting from the side portion, and at least one locating element positioned within the groove wherein, when mounted in the stationary configuration, said universal shelf module further includes a first support unit having first and second side frame sections joined to a rear frame section, each, of the first and second side frame sections including at least one mounting aperture and at least one locating tab, each of said at least one mounting aperture of the first support unit receiving a corresponding one of each of the at least one mounting boss and each of the at least one locating tab of the first support unit cooperating with a corresponding one of each of the at least one locating element so as to secure the shelf unit to the first support unit; and when mounted in the sliding configuration, said universal shelf module further includes a second support unit having first and second side frame sections joined to a rear frame section as well as first and second glide members slidingly supported on corresponding ones of the first and second side frame sections, each of said first and second glide members including at least one mounting aperture and at least one locating tab, each of said at least one mounting aperture of the first and second glide members receiving a corresponding one of each of the at least one mounting boss and each of the at least one locating tab of the first and second glide members cooperating with a corresponding one of each of the at least one locating element so as to slidingly secure the shelf unit to the second support unit.

2. The refrigerator according to claim 1, wherein the at least one locating element on the shelf unit includes a plurality of locating elements arranged on the peripheral frame.

3. The refrigerator according to claim 2, wherein the at least one mounting boss on the shelf unit includes a plurality of mounting bosses formed on the peripheral frame.

4. The refrigerator according to claim 3, wherein the at least one tab member on the first support unit includes a plurality of tab members that extend upward from each of the first and second side frame sections, said plurality of tab members being adapted to interengage with corresponding ones of the locating elements on the peripheral frame to retain the shelf unit.

5. The refrigerator according to claim 3, wherein the at least one mounting aperture of the first support unit includes a plurality of mounting apertures formed in each of the first and second side frame sections, said plurality of mounting apertures being adapted to interengage with corresponding ones of the mounting bosses on the peripheral frame to retain the shelf unit.

6. The refrigerator according to claim 3, wherein the at least one locating tab on each of the first and second glide members includes a plurality of locating tabs on each of the first and second glide members, said plurality of locating tabs being adapted to cooperate with corresponding ones of the plurality of locating elements on the peripheral frame to mount the shelf unit.

7. The refrigerator according to claim 6, wherein the at least one mounting aperture on each of the first and second glide members is constituted by a plurality of mounting apertures on each of the first and second glide members, said plurality of mounting apertures being adapted to engage with corresponding ones of the plurality of mounting bosses formed in the peripheral frame to mount the shelf unit.

8. The refrigerator according to claim 1, wherein the rear frame section of each of the first and second support units includes at least one hook member adapted to hang on the at least one support rail so as to position the universal shelf module in the fresh food compartment.

9. The refrigerator according to claim 8, wherein the at least one hook member is configured to slide on the at least one support rail so as to enable the universal shelf module to laterally shift in the fresh food compartment.

10. The refrigerator according to claim 1, wherein each of the first and second side frame sections of the first support unit includes corresponding first and second glide rails, said glide rails being adapted to slidingly support a refrigerator drawer.

11. A refrigerator comprising:

a cabinet shell;

a liner arranged within the cabinet shell, said liner defining at least a fresh food compartment having top, bottom, rear and opposing side walls;

a door pivotally mounted relative to the cabinet shell for selectively closing the fresh food compartment;

at least one shelf support rail mounted to one of the rear and opposing side walls of the fresh food compartment, while extending along the rear wall;

a universal shelf unit having a base portion and a peripheral frame, said peripheral frame including a front frame member, a rear frame member and opposing side frame members joined to the front and rear frame members, each of said opposing side frame members including a bottom edge portion, a toy surface portion, a side portion extending from the bottom edge portion to the top surface portion, a channel defining member which is sized to receive the base portion and being spaced from the side portion to define a groove, at least one mounting boss projecting from the side portion and at least one locating element; and at least one of a first means for mounting the universal shelf unit in one of a stationary configuration and a second means for mounting the universal shelf in a sliding configuration, wherein when mounted in the stationary configuration, the universal shelf unit is directly mounted to a first support unit and when mounted in the sliding configuration, the universal shelf unit is indirectly mounted to a second support unit.

12. The refrigerator according to claim 11, wherein the peripheral frame includes a plurality of locating elements.

13. The refrigerator according to claim 12, wherein the peripheral frame includes a plurality of mounting bosses.

14. The refrigerator according to claim 13, wherein the first support unit includes first and second side frame sections, said mounting means including a plurality of upwardly extending tab members, said plurality of tab members being adapted to interengage with corresponding ones of the locating elements on the peripheral frame to retain the shelf unit in the stationary configuration.

15. The refrigerator according to claim 13, wherein the first mounting means further includes a plurality of mounting apertures formed in each of the first and second side frame sections of the first support unit, said plurality of mounting apertures being adapted to interengage with corresponding ones of the mounting bosses on the peripheral frame to retain the shelf unit in the stationary configuration.

16. The refrigerator according to claim 13, further comprising: first and second glide members slidingly supported upon the second support unit, said mounting means including a plurality of locating tabs formed on each of the first and second glide members, said plurality of locating tabs being adapted to cooperate with corresponding ones of the plurality of locating elements on the peripheral frame to mount the shelf unit in the sliding configuration.

17. The refrigerator according to claim 16, wherein the second mounting means further includes a plurality of mounting apertures formed on each of the first and second glide members, said plurality of mounting apertures being adapted to interengage with corresponding ones of the plurality of mounting bosses formed in the peripheral frame to mount the shelf unit in the sliding configuration.

18. The refrigerator according to claim 11, further comprising: at least one hook member provided on the rear frame section of one of the first and second support units, said at least one hook member being adapted to cantilever the universal shelf unit from the at least one support rail.

19. The refrigerator according to claim 18, wherein the hook member is configured to slide on the at least one support rail so as to enable the universal shelf unit to laterally shift in the fresh food compartment.

20. A universal shelf module configured to be mounted in one of a stationary configuration and in a sliding configuration in a refrigerator comprising:

a shelf unit having a base portion and a peripheral frame, said peripheral frame including a front frame member, a rear frame member and opposing side frame members that join with the front and rear frame members, each of said opposing side frame members including a bottom edge portion, a top surface portion, a side portion extending from the bottom edge portion to the top surface portion, a channel defining member which is sized to receive the base portion and spaced from the side portion to define a groove, and at least one mounting boss projecting from the side portion, and at least one locating element positioned within the groove;

when mounted in the stationary configuration, said universal shelf module further includes a first support unit having first and second side frame sections joined to a rear frame section, each of the first and second side frame sections including at least one mounting aperture and at least one locating tab, each of said at least one mounting aperture of the first support unit receiving a corresponding one of each of the at least one mounting boss and each of the at least one locating tab of the first support unit cooperating with a corresponding one of each of the at least one locating element so as to secure the shelf unit to the first support unit; and when mounted in the sliding configuration, said universal shelf module further includes a second support unit having first and second side frame sections joined to a rear frame section as well as first and second glide members slidingly supported on corresponding ones of the first and second side frame sections, each of said first and second glide members including at least one mounting aperture and at least one locating tab, each of said at least one mounting aperture of the first and second glide members receiving a corresponding one of each of the at least one mounting boss and each of the at least one locating tab of the first and second glide members cooperating with a corresponding one of each of the at least one locating element so as to slidingly secure the shelf unit to the second support unit.

* * * * *